US007477201B1

(12) United States Patent
Bit-Babik et al.

(10) Patent No.: US 7,477,201 B1
(45) Date of Patent: Jan. 13, 2009

(54) LOW PROFILE ANTENNA PAIR SYSTEM AND METHOD

(75) Inventors: Giorgi Bit-Babik, Sunrise, FL (US); Carlo Di Nallo, Plantation, FL (US); John A. Svigelj, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/847,459

(22) Filed: Aug. 30, 2007

(51) Int. Cl.
*H01Q 1/38* (2006.01)

(52) U.S. Cl. ..... 343/702; 343/700 MS; 343/846; 343/745

(58) Field of Classification Search ..... 343/700 MS, 343/702, 742, 767, 745, 846, 867
See application file for complete search history.

(56) References Cited

U.S. PATENT DOCUMENTS

| | | | | |
|---|---|---|---|---|
| 6,133,883 | A | 10/2000 | Munson et al. | |
| 6,414,642 | B2 | 7/2002 | Honda et al. | |
| 6,469,673 | B2 | 10/2002 | Kaiponen | |
| 6,498,586 | B2 | 12/2002 | Pankinaho | |
| 6,614,401 | B2 * | 9/2003 | Onaka et al. | 343/702 |
| 6,646,618 | B2 | 11/2003 | Sievenpiper | |
| 6,911,940 | B2 | 6/2005 | Poilasne et al. | |
| 6,985,108 | B2 | 1/2006 | Mikkola et al. | |
| 7,242,352 | B2 | 7/2007 | Tavassoli Hozouri | |
| 7,250,913 | B2 | 7/2007 | Chang et al. | |
| 2003/0103015 | A1 * | 6/2003 | Oh et al. | 343/867 |
| 2004/0058723 | A1 * | 3/2004 | Mikkola et al. | 455/575.7 |
| 2005/0280586 | A1 | 12/2005 | Bit-Babik | |
| 2007/0139276 | A1 | 6/2007 | Svigelj | |
| 2008/0062045 | A1 * | 3/2008 | Dinallo et al. | 343/700 MS |

* cited by examiner

*Primary Examiner*—Douglas W. Owens
*Assistant Examiner*—Chuc Tran
(74) *Attorney, Agent, or Firm*—Valerie M. Davis; Anthony P. Curtis

(57) ABSTRACT

An antenna system includes a ground plane including a first corner and a second corner that are positioned along a first common edge. A first antenna element is disposed at the first corner of the ground plane and includes a first slot. A second antenna element is disposed at the second corner of the ground plane and includes a second slot. The first antenna element and the second antenna element are fed with an electromagnetic signal and the electromagnetic signal at the first antenna element is approximately 90 degrees shifted from the signal at the second antenna element. The first antenna element and the second antenna element form an antenna structure, and the antenna structure transmits circularly polarized radiation.

20 Claims, 7 Drawing Sheets

LOW PROFILE ANTENNA PAIR SYSTEM AND METHOD

TECHNICAL FIELD

The technical field relates generally to wireless communication devices and more particularly to antennas for wireless communication devices.

BACKGROUND

The deployment of cellular networks, satellite networks and other wireless networks has greatly expanded the use of mobile wireless communication devices. Whether a wireless communication device is a handheld device or a vehicle mounted device, there is an interest in making the devices small so that they can be conveniently carried or accommodated in small spaces.

Advances, by many orders of magnitude, in the degree of integration and miniaturization of electronics over the past few decades have facilitated extreme miniaturization of transceiver electronic circuits. However, the methods and means used to miniaturize electronic circuits cannot always be applied to miniaturize antennas because antennas operate under the principles of Maxwell's equations, which, roughly speaking, stipulate that if antenna efficiency is to be preserved, the size of the antenna must be scaled according to the wavelength of the carrier frequency of the wireless signals that are to be received and/or transmitted.

Compounding the challenge of reducing antennas size is that for many wireless communication devices, the antenna system needs to support operation at multiple frequencies, for instance, in multiple relatively wide frequency bands. However, using separate antennas to support separate operating frequencies has also led to difficulty in reducing the space occupied by the antenna system.

In addition, other antenna systems have attempted to transmit circularly polarized radiation. Unfortunately, these systems have not been able to be successfully miniaturized, for at least the reason that individual antenna element bandwidth and efficiency are reduced upon miniaturization and, furthermore, elements forming a system have not been able to be properly isolated, thereby degrading system performance.

Thus, there exists a need for low profile antenna systems, which address at least some of the shortcomings of past and present techniques.

BRIEF DESCRIPTION OF THE FIGURES

The accompanying figures, where like reference numerals refer to identical or functionally similar elements throughout the separate views, which together with the detailed description below are incorporated in and form part of the specification and serve to further illustrate various embodiments of concepts that include the claimed invention, and to explain various principles and advantages of those embodiments.

Figure 1:
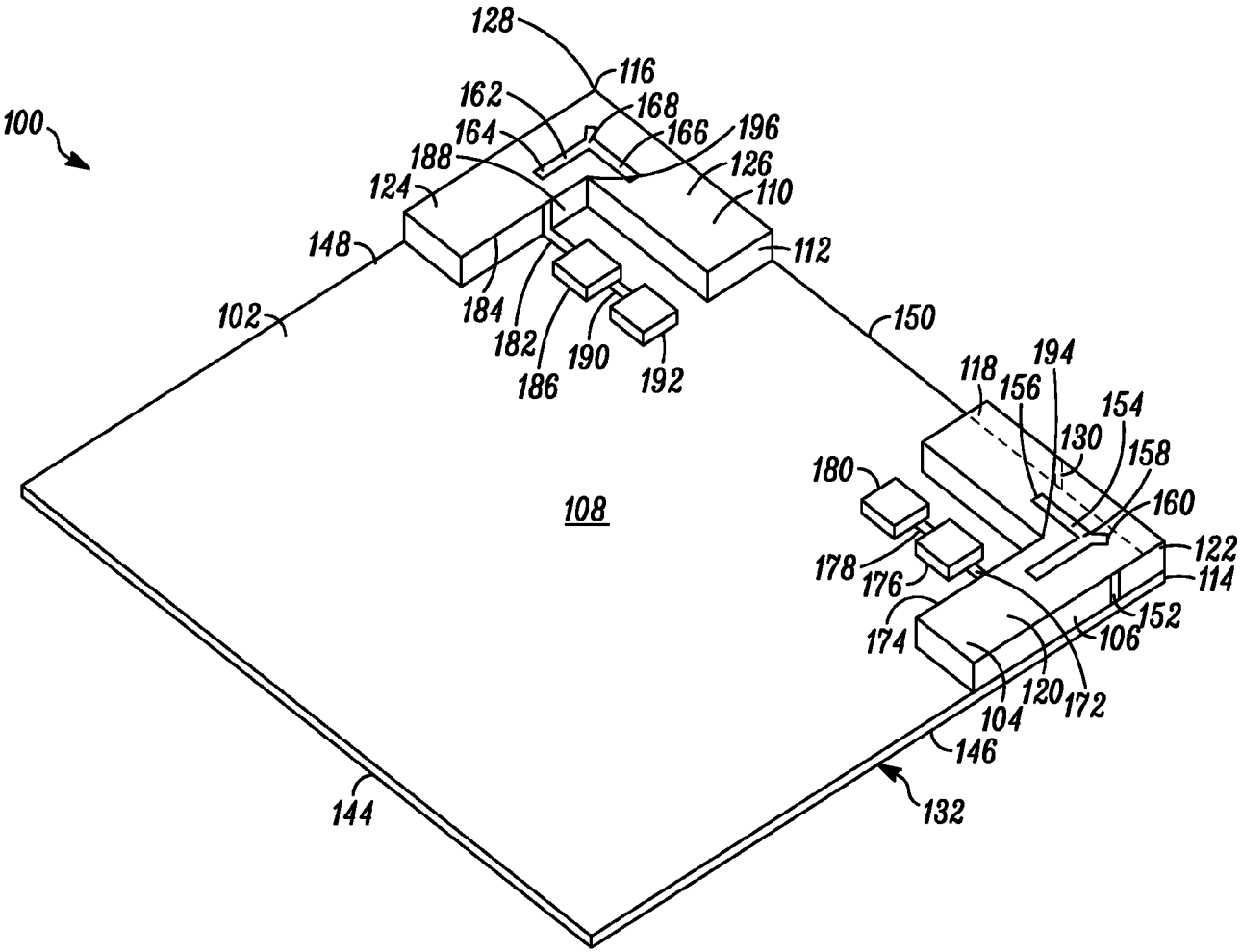
FIG. 1 is a top view of an antenna system in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. In addition, the description and drawings do not necessarily require the order illustrated. Apparatus and method components have been represented where appropriate by conventional symbols in the drawings, showing only those specific details that are pertinent to understanding the various embodiments so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

DETAILED DESCRIPTION

Generally speaking, pursuant to the various embodiments, antenna systems are provided that are small in size, low in profile, and are operated at multiple frequencies. These approaches also allow for the transmission and reception of circularly polarized radiation and have antenna elements that are effectively isolated from each other. Those skilled in the art will realize that the above recognized advantages and other advantages described herein are merely illustrative and are not meant to be a complete rendering of all of the advantages of the various embodiments.

In some of these embodiments, an antenna system includes a ground plane having a first corner and a second corner. The first corner is in spaced relation to the second corner, and the first corner and the second corner are positioned along a first common edge of the ground plane. In one example, the first common edge is less than one third wavelength in length (or less) with respect to a frequency of interest.

A first antenna element is disposed at the first corner of the ground plane and includes a first slot, and a second antenna element is disposed at the second corner of the ground plane and includes a second slot. A first feed terminal is coupled to the first antenna element and a second feed terminal is coupled to the second antenna element.

The ground plane includes a first reentrant perimeter that extends inward underneath at least a first portion of the first antenna element. The ground plane also includes a second reentrant perimeter that extends inward underneath at least a second portion of the second antenna element. By one approach, the first portion of the first antenna element and the second portion of the second antenna element do not overlie the ground plane.

A first current pattern is established by feeding the first antenna element via the first feed terminal and flows at least partially around the first slot and a second current pattern is established by feeding the second antenna element via the second feed terminal and flows at least partially around the second slot. The first antenna element and the second antenna element are fed with an electromagnetic signal and the electromagnetic signal at the first antenna element is approximately 90 degrees shifted from the signal at the second antenna element. The first antenna element and the second antenna element form an antenna structure and the antenna structure transmits circularly polarized radiation.

The ground plane can assume various shapes and sizes. For example, the ground plane can comprise a shape that is a polygon such as a square or rectangle. Other examples of shapes are possible.

The first antenna element and the second antenna element may also be of various shapes and sizes. In one example, the first antenna element and the second antenna element are substantially v-shaped. In another example, the first antenna element and the second antenna element have lengths of approximately one-eighth a wavelength of interest. Other shapes and dimensions may also be used.

In other examples, selected portions of the ground plane are removed from under the first antenna element and the second antenna element. In yet other examples, a dielectric material is positioned between the first antenna element and the ground plane, and the second antenna element and the ground plane.

In others of these embodiments, a first tuning circuit is coupled to the first antenna element and a second tuning circuit is coupled to the second antenna element. The first tuning circuit and the second tuning circuit are adapted and configured to change a center operating frequency of the first and second antenna elements. In one example, the first tuning circuit and the second tuning circuit comprise at least one capacitor. In other examples, the first tuning circuit is actuated by a first switch and the second tuning element is actuated by a second switch.

In still others of these embodiments, the ground plane further includes a third corner and a fourth corner. The third corner is in spaced relation to the fourth corner, and the third corner and the fourth corner lay along a second common edge of the ground plane. A third antenna element is disposed at the third corner of the ground plane and includes a third slot, and a fourth antenna element is disposed at the fourth corner of the ground plane and includes a fourth slot. In this example, the first antenna element and the second antenna element operate in a first frequency band and the third antenna element and the fourth antenna element operate in a second frequency band.

Figure 2:
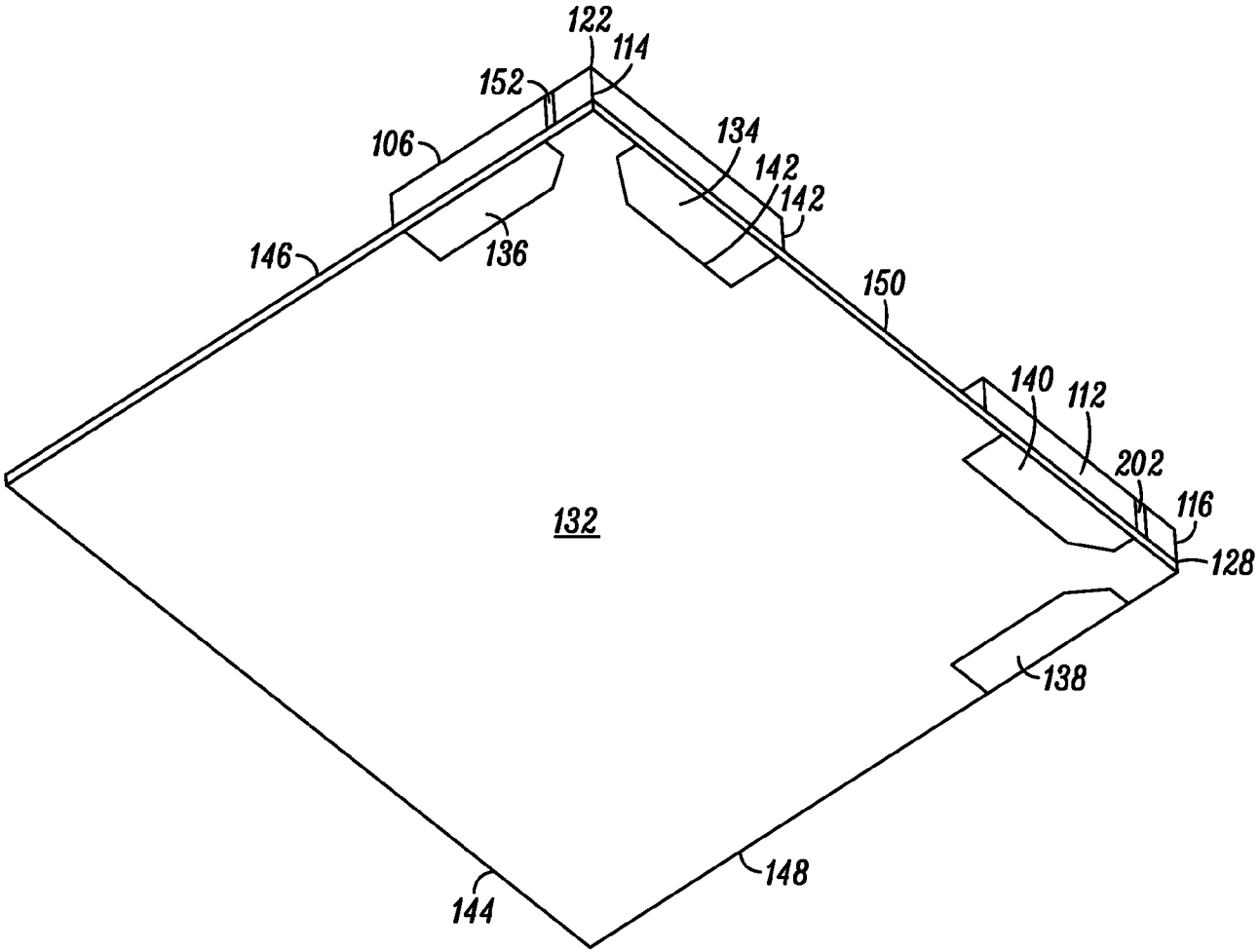
FIG. 2 is bottom view of the antenna system of FIG. 1 in accordance with some embodiments.

Turning now to FIGS. 1 and 2, an antenna system 100 is described. FIG. 1 is a top view of the antenna system 100 and FIG. 2 is a bottom view of the antenna system 100 (shown in FIG. 1). The antenna system 100 is disposed on a square dielectric substrate 102. The dielectric substrate 102 is constructed from any suitable material such as Duroid, FR-4, or some other suitable material. A first antenna element 104 is supported by a first dielectric spacer 106 on a top surface 108 of the dielectric substrate 102. Similarly a second antenna element 110 is supported by a second dielectric spacer 112 above the dielectric substrate 102. The first dielectric spacer 106 and the second dielectric spacer 112 are constructed of a suitable material such as polytetrafluoroethylene, or some other low loss tangent material.

The first antenna element 104 and the second antenna element 110 are constructed of any suitable material such as a highly conductive material such as copper or silver. The first antenna element 104 and the second antenna element 110 can be formed by metal working (e.g., stamping, machining, or the like), lift-off deposition, printing, lithography, electroless deposition or other suitable processes. The first antenna element 104 is located at a first vertex 114 of the square dielectric substrate 102 and the second antenna element 110 is located at a second vertex 116 of the square dielectric substrate 102.

In as much as a square is a convex polygon, positioning the first antenna element 104 and the second antenna element 110 at vertices increases the utilizable electrical length of the antenna 100, thereby allowing the antenna 100 to be smaller for a given operating frequency. As shown in FIG. 1, the elements 104 and 110 are positioned along a common edge 150.

The volume of the antenna 100, judged in view of the operating wavelengths of the antenna, is relatively small. In one example, the antenna system 100 is a square 30 centimeters by 30 centimeters (e.g., one third a wavelength or less) and a height of 0.5 centimeters (e.g., $1/200^{th}$ a wavelength or less). The placement of the elements 104 and 110 along the edge 150 and at a first corner 122 and a second corner 128, respectively, improves the isolation of the elements and the performance of the system.

The first antenna element 104 comprises a first linear segment 118 and a second linear segment 120 that join contiguously at a right angle forming a first corner 122. The first corner 122 is located at the first vertex 114 of the antenna 100. Similarly, the second antenna element 110 comprises a third linear segment 124 and a fourth linear segment 126 that join contiguously at a right angle forming a second corner 128. The second corner 128 of the second antenna element 110 is located at the second vertex 116 of the antenna 100. A first signal feed conductor 130 extends from a top surface 108 of the dielectric substrate 102 proximate the first corner 122 to the first linear segment 118.

The antenna 100 further comprises a ground plane 132 disposed on the dielectric substrate 102 opposite the dielectric spacers 106 and 112 and the antenna elements 104, 110. Alternatively, the ground plane 132 is located on the top surface 108 of the dielectric substrate 102 as the aforementioned components, or within a multilayered substrate that is used in lieu of the dielectric substrate 102. Such a multilayered substrate can take the form of a multilayer circuit board that has one or more ground planes.

As shown in FIG. 2, the ground plane 132 has four deleted areas 134, 136, 138, and 140, including a first deleted area 134 and a second deleted area 136 that are disposed under the first segment 118 and the second segment 120 of the first antenna element 104 respectively. Similarly a third deleted area 138 and a fourth deleted area 140 are located under the third segment 124 and the fourth segment 126 of the second antenna element 110 respectively. Accordingly, a perimeter 142 of the ground plane 132 is reentrant (with respect to an otherwise square shape) at the deleted areas 134, 136, 138, and 140. The ground plane 132 can be patterned using various methods such as the methods mentioned above in reference to the antenna elements 104 and 110.

The first linear segment 118 and the second linear segment 120 extend parallel to a first edge 150 and a second edge 146 of the antenna 100 that join at the first vertex 114. Similarly, the third segment 124 and the fourth segment 126 extend parallel to a third edge 148 and the first edge 150 of the antenna 100 that join at the second vertex 116. A fourth edge 144 is parallel to the first edge 150. The antenna elements 104 and 110 are shaped to guide currents along the edges 144, 146, 148, and 150, thereby bringing the currents over the deleted areas 134, 136, 138, and 140. The deleted areas 134, 136, 138, and 140 create a field configuration that increases the radiation efficiency of the antenna 100, lowering the Q of the antenna, and thereby increasing the bandwidths of the antenna 100 for modes associated with two antenna elements 104 and 110. Furthermore, having the segments 118, 120, 124, and 126 of the antenna elements 104 and 110 run along the edges 144, 146, 148, and 150 of the antenna 100 enhances the radiation associated with the deleted areas by inducing strong currents, charge densities and fields on the perimeter 142, where the fields more readily couple to free space (compared to a case where the deleted area is interior to the ground plane 132).

The antenna elements 104 and 110 may be fed by separate linear signals that are approximately 90 degrees shifted. In so doing, a circularly polarized signal is created. The placement and operation of the antenna elements 104 and 110 ensures their isolation from each other. Consequently, the antenna elements 104 and 110 may be operated as an antenna pair.

A first ground conductor 152 extends from the second linear segment 120 of the first antenna element 104 to the ground plane 132 proximate the first corner 122. A second ground conductor 202 extends from the third linear segment 124 of the second antenna element 110 to the ground plane 132 proximate the second corner 128. A second signal feed conductor (not shown) extends from the top surface 108 of the dielectric substrate 102 to the fourth linear segment 126 of the second driven antenna element 110. Signal lines (not shown) that are suitably formed on the top surface 108 of the dielectric substrate 102 connect the antenna elements 104 and 110 to transceiver circuits (not shown). Alternatively, the antenna elements 104 and 110 may be coupled to transceiver circuits located on a separate circuit board.

The proximity of the signal feed conductors 130, and the ground conductors 152 and 202 to the corners 122 and 128 of the antenna elements 104 and 110 affects input impedances of the antenna 100. A particular spacing which can be found by experimentation yields a particular desired real impedance e.g., 50 Ohms. The spacing that gives a desired real impedance is also dependent on the spacing of the antenna elements 104 and 110 from the ground plane 132. As the spacing of the antenna elements 104 and 110 from the ground plane increases the input impedance will increase. In one example, the antenna system 100 is designed for operation at 300 MHz, and has an overall edge dimension of 30 cm, in which case the lengths of the linear segments 118, 120, 124, and 126 are about 130 millimeters (one eighth a wavelength or less) and the antenna elements 104 and 110 spaced from the ground plane 132 by 5 mm (e.g., $1/200^{th}$ wavelength) or less, and the ground conductors 152 and 202 and the signal feed conductors 130 are suitably spaced from the corners 122 and 128 by about 4 mm ($1/200^{th}$ a wavelength or less).

Referring now again to FIG. 1, a right angle shaped slot 154 is formed in the first antenna element 104. The right angle shaped slot 154 includes a fifth linear segment 156 and a sixth linear segment 158 that join at a third corner 160, that is located proximate the first corner 122 of the first antenna element 104. Referring now again to FIG. 2, the fifth linear 156 segment is arranged parallel to the first linear segment 118, and the sixth linear segment is arranged parallel to the second linear segment 120.

A right angle shaped slot 162 is formed in the second antenna element 110. The right angle shaped slot 162 includes a seventh linear segment 164 arranged parallel to the third linear segment 124 of the second antenna element 110 and an eighth linear segment 166, that extends parallel to the fourth linear segment 126 of the second antenna element 110 and intersects the seventh linear segment 164 at an intersection 168, that is located proximate the second corner 128 of the second antenna element 110. Although linear segments are discussed above, alternatively, curved or curvilinear segments may be used.

The right angle slot 154 and the right angle shaped slot 162 are used to control the operating frequencies of the first and second antennas, respectively. In general, increasing the length of the slot legs will reduce the operating frequency of the antenna element.

A first microstrip 172 connects an inside edge 174 of the second segment 120 of the first antenna element 104 to a first switch 176. The first microstrip 172 runs up an inward facing side wall (not visible) of the first dielectric spacer 106. A second microstrip 178 connects the first switch 176 to a first capacitor 180. Thus, the first switch 176 selectively couples the first antenna element to the first capacitor 180. Similarly, a third microstrip 182 connects an inside edge 184 of the third segment 124 of the second antenna element 110 to a second switch 186. The third microstrip 182 runs up an inward facing side wall 188 of the second dielectric spacer 112. A fourth microstrip 190 connects the second switch 186 to a second capacitor 192. The first capacitor 180 and the second capacitor 192 are suitably grounded to the ground plane 132 through vias (not shown) that pass through the dielectric substrate 102. By selectively coupling the capacitors 180 and 192 to the antenna elements 104 and 110 the center frequency of the antenna 100 can be shifted, effectively broadening the bandwidth of the antenna 100. This broadening effect compounds the bandwidth broadening provided by the deleted areas 134, 136, 138, and 140 of the ground plane 132 and the bandwidth broadening provided by the slots 154 and 162. The first switch 176 and the second switch 186 can be Micro-Electro Mechanical (MEMS) switches, or a solid state switch.

The exact positions on the inside edges 174 and 184 of the antenna elements at which the antenna elements 104 and 110 are capacitively loaded (i.e., the points at which the first microstrip 172 and the third microstrip 182 connect) are suitably close to an inside corner 194 of the first antenna element 104, and an inside corner 196 of the second antenna element 110 respectively. If it is only necessary to obtain a limited tuning range, the loading point could be connected at the inside corners 194 and 196, but to obtain an increased tuning effect the point of connection is located away from the corners 194 and 196. On the other hand, moving the loading points too far away from the inside corners 194 and 196 (e.g., beyond the longitudinal midpoints of the linear segments 118, 120, 124, and 126) may lead to degraded antenna performance.

Figure 3:
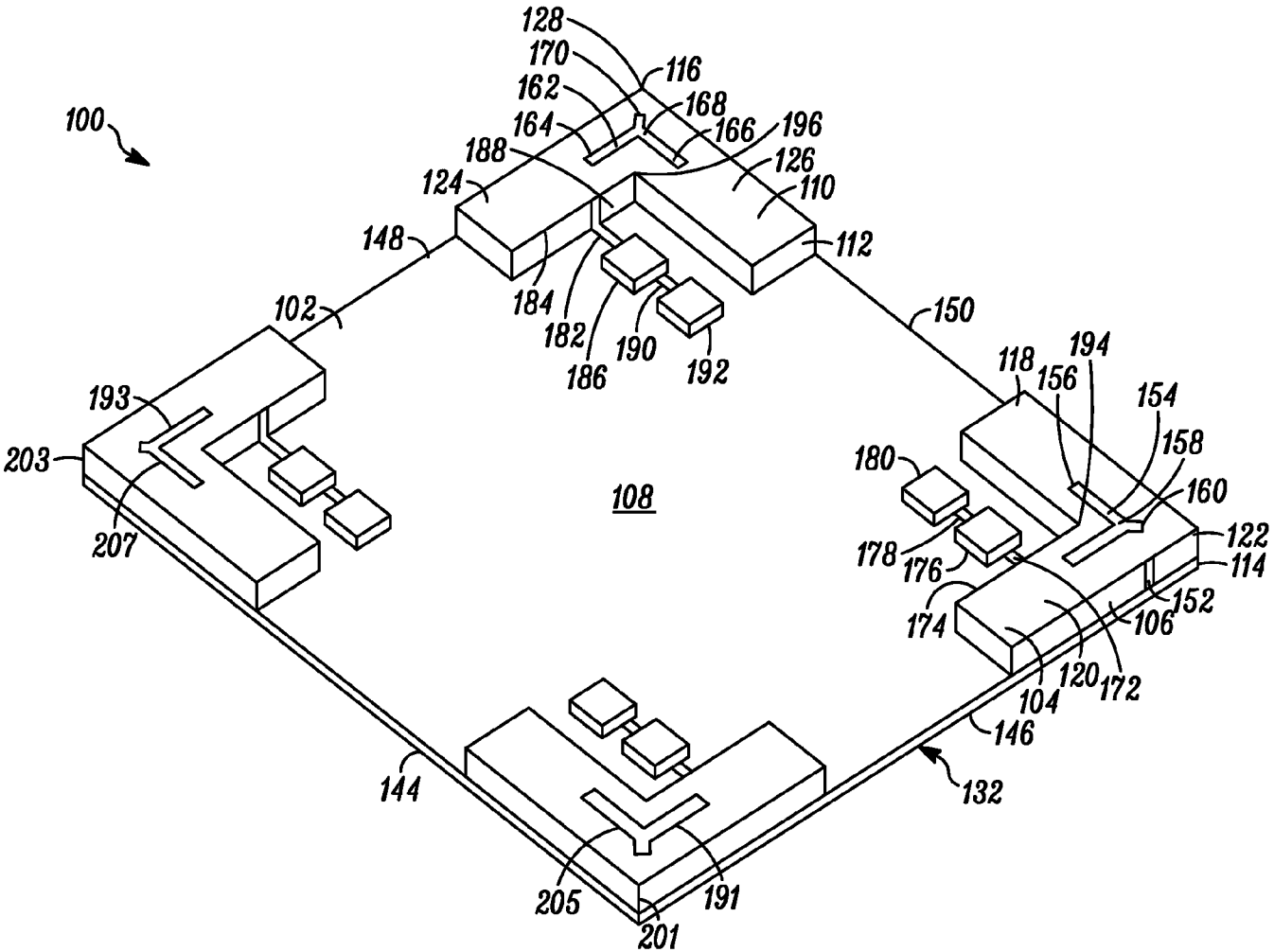
FIG. 3 is a top view of another example of an antenna system in accordance with some embodiments.
Figure 4:
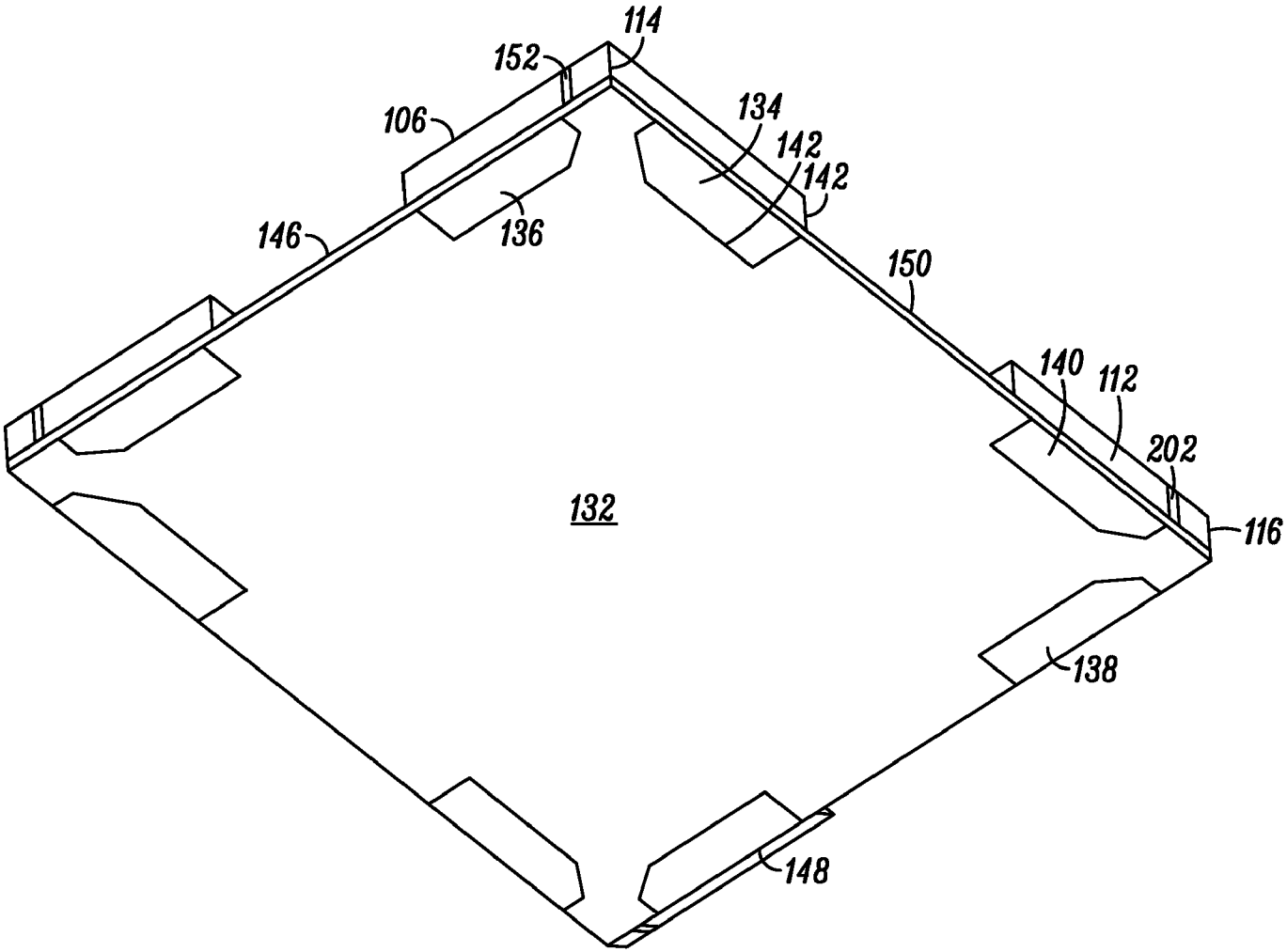
FIG. 4 is a bottom view of the antenna system of FIG. 3 in accordance with some embodiments.

Referring now to FIGS. 3 and 4, an example of a system with additional antenna elements added is described. A third antenna element 191 and a fourth antenna element 193 are positioned at a third corner 201 and a fourth corner 203 respectively. The antenna elements 191 and 193 have the same components as the antenna elements 104 and 110 discussed above. Consequently, the individual components of the antenna elements will not be described in further detail herein.

The third corner 201 is in spaced relation to the fourth corner 203, and the third corner and the fourth corner lay along the edge 144 of the ground plane. The third antenna element 191 is disposed at the third corner 201 of the ground plane and includes a third slot 205, and a fourth antenna element 193 is disposed at the fourth corner 203 of the ground plane and includes a fourth slot 207. In this example, the first antenna element 104 and the second antenna 110 element operate in a first frequency band (and as a first antenna pair) and the third antenna element 191 and the fourth antenna element 193 operate in a second frequency band (and as a second antenna pair). In other words the first and second elements act as an independent system compared with the third and fourth antenna elements. As with the first and second antenna elements 104 and 110, the third and fourth antenna elements 191 and 193 transmit/receive signals with an approximately 90 degrees phase shift. As will be appreciated, each of the antenna elements 104, 110, 191, and 193 are capable (by themselves) of only transmitting/receiving linearly polarized radiation. In other words, antenna pairs (i.e., antenna element 104 and 110, and 191 and 193) are used to transmit/receive the circularly polarized radiation.

Figure 5:
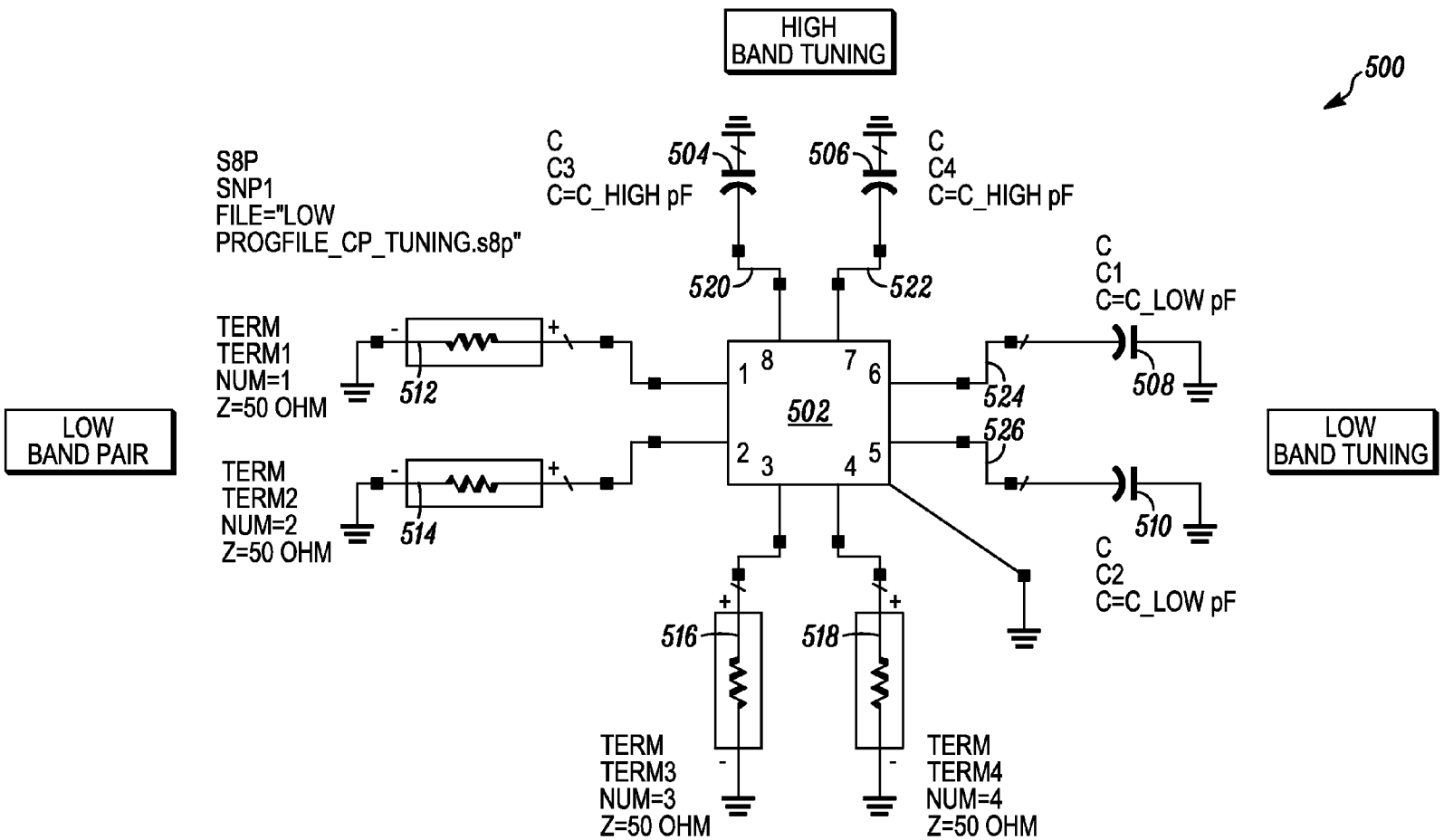
FIG. 5 is an electrical diagram of an antenna system in accordance with some embodiments.

Referring now to FIG. 5, an electrical diagram of an antenna system 500 is described. Four antenna elements (shown as element 502) are positioned on a substrate. Each of the antenna elements is coupled to a switch/capacitor combination that can be used to adjust the center operating frequency of an antenna pair. More specifically, a first antenna element is coupled to a first capacitor 504 and a first switch 520. A second antenna element is coupled to a second capacitor 506 and a second switch 522. A third antenna element is coupled to a third capacitor 508 and a third switch 524. Finally, a fourth antenna element is coupled to a fourth capacitor 510 and a fourth switch 526. Resistors 512, 514, 516, and 518 are used to model the source impedance with respect to 50 ohms for each of the antenna feed points.

The capacitors are used as tuning elements. In one approach, the tuning (accomplished by opening and closing the switches and/or adjusting the component values) can be done simultaneously for both antenna elements. Since the antenna system produces circularly polarized radiation and has a limited bandwidth, tuning can significantly reduce or eliminate any problems associated with the limited bandwidth.

Figure 6:
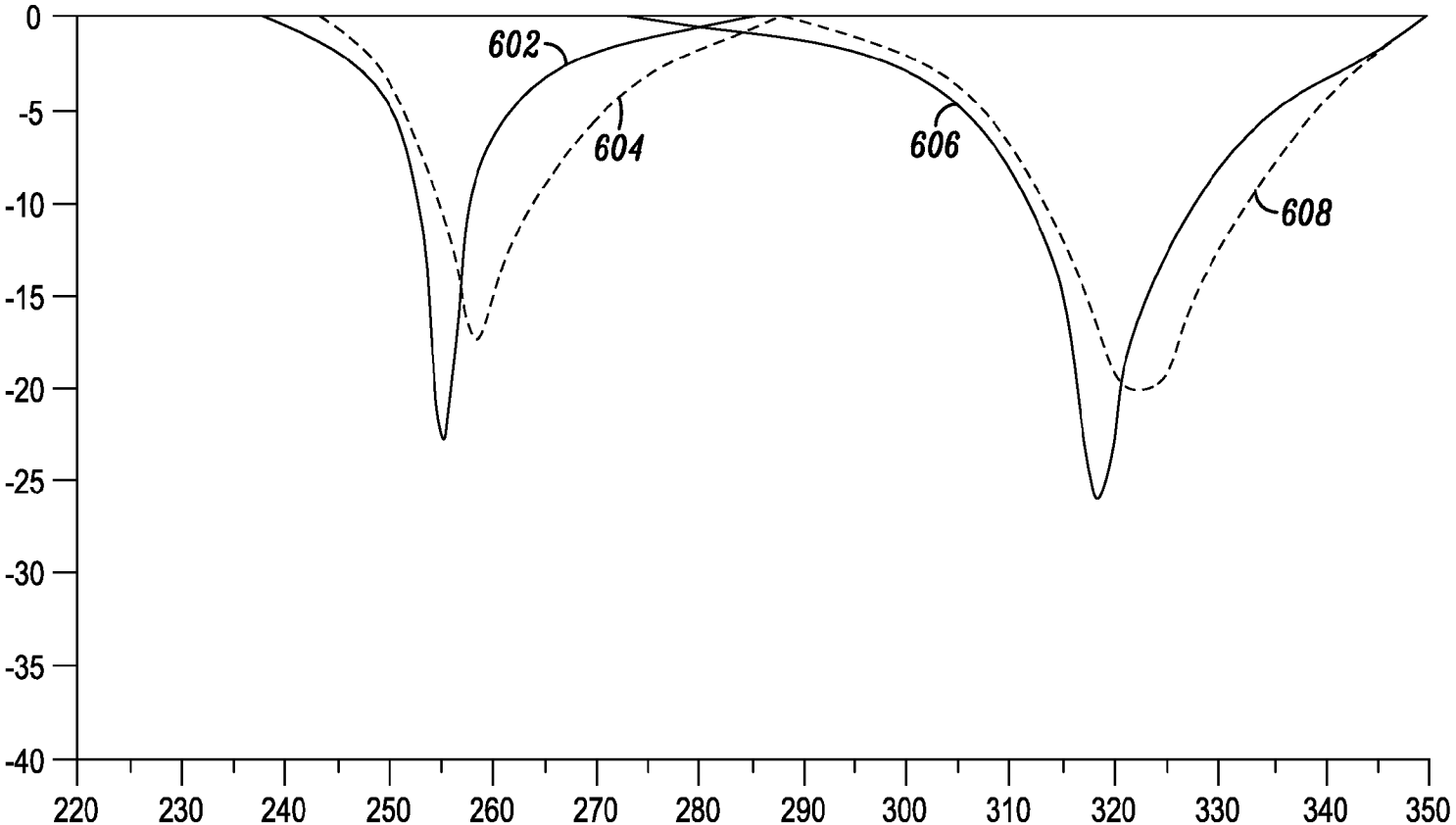
FIG. 6 is a diagram illustrating one aspect of the performance of an antenna system in accordance with some embodiments.

Referring now to FIG. 6, a diagram illustrating one aspect of the performance of the present system is described. In this example, the horizontal axis represents a frequency and the vertical axis represents S-parameter magnitude (in dB). As shown in FIG. 6, tuning circuits are used to adjust the positions of the operating frequency. A first position 602 can be adjusted to a second position 604 and a third position 606 can be adjusted to be a fourth position 608.

Figure 7:
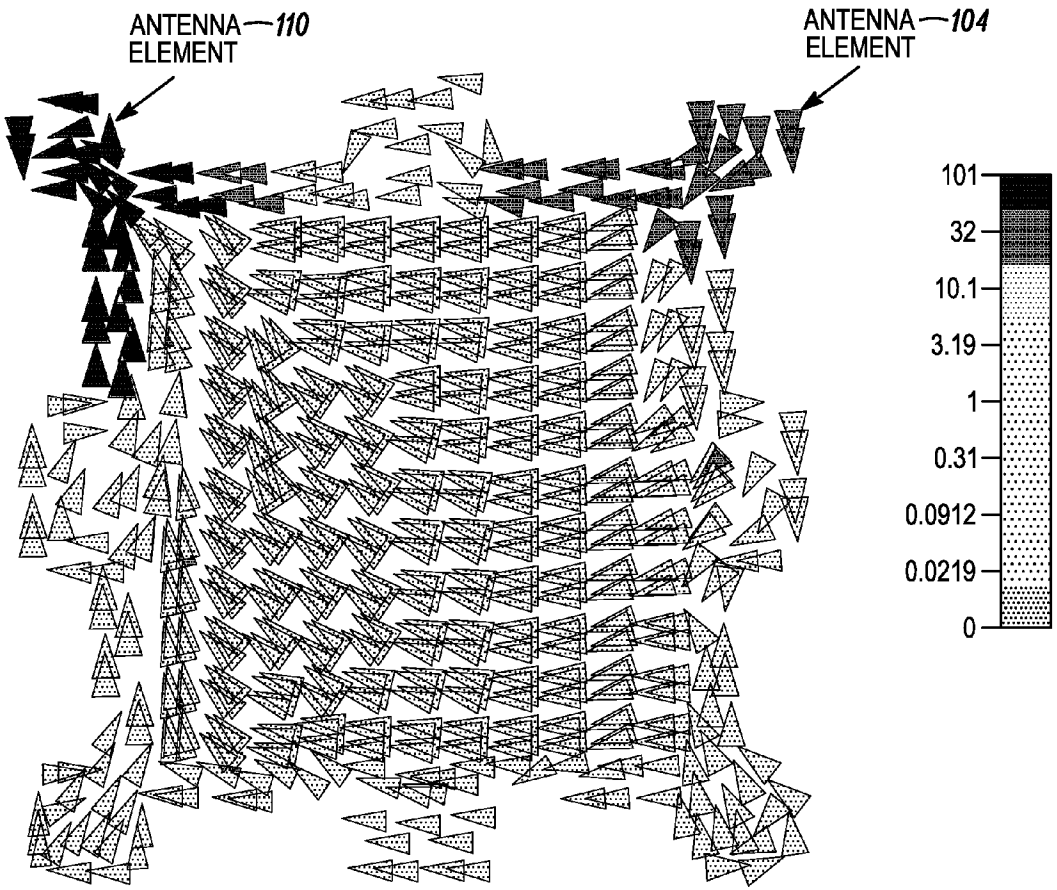
FIG. 7 is a diagram illustrating another aspect of the performance of an antenna system in accordance with some embodiments.

Referring now to FIG. 7, a plan view of antenna system 100 shown in FIGS. 1 and 2 comprises a superposed current distribution configuration. As shown in FIG. 7, the current pattern that is established when operating the antenna 100 includes a current flow toward the antenna element 110. The current is concentrated in areas overlying the ground plane near the antenna elements 104 and 110. The deleted areas of the ground plane serve to concentrate the current toward the inside of the antenna element 110. An effect of having both a slot and the deleted areas is to create a convoluted current path. This convoluted current path serves to increase the effective electrical size of the antenna 100, thereby allowing the antenna to have a relatively reduced size for a given frequency of operation.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna comprising:

a ground plane having a first corner and a second corner, the first corner being in spaced relation to the second corner, the first corner and the second corner lying along a first common edge of the ground plane;

a first antenna element disposed at the first corner of the ground plane and including a first slot, and a second antenna element disposed at the second corner of the ground plane and including a second slot; and a first feed terminal coupled to the first antenna element and a second feed terminal coupled to the second antenna element, wherein the ground plane comprises a first reentrant perimeter that extends inward underneath at least a first portion of the first antenna element and wherein the ground plane comprises a second reentrant perimeter that extends inward underneath at least a second portion of the second antenna element, and wherein the at least first portion of the first antenna element and the at least second portion of the second antenna element do not overlie the ground plane, wherein a first current pattern is established by feeding the first antenna element via the first feed terminal and flows at least partially around the first slot and wherein a second current pattern is established by feeding the second antenna element via the second feed terminal and flows at least partially around the second slot, and wherein the first antenna element and the second antenna element are fed with an electromagnetic signal, the electromagnetic signal at the first antenna element being approximately 90 degrees shifted from the signal at the second antenna element, the first antenna element and the second antenna element forming an antenna structure, the antenna structure transmitting circularly polarized radiation.

2. The antenna system of claim 1 wherein the ground plane comprises a shape that is a polygon.

3. The antenna system of claim 1 further comprising a dielectric positioned between the first antenna element and the ground plane, and the second antenna element and the ground plane.

4. The antenna system of claim 1 further comprising a first tuning circuit coupled to the first antenna element and a second tuning circuit coupled to the second antenna element, wherein the first tuning circuit and the second tuning circuit are adapted and configured to change a center operating frequency.

5. The antenna system of claim 4 wherein the first tuning circuit and the second tuning circuit comprise at least one capacitor.

6. The antenna system of claim 4 wherein the first tuning circuit is actuated by a first switch and the second tuning element is actuated by a second switch.

7. The antenna system of claim 1 wherein the first antenna element and the second antenna element are substantially v-shaped.

8. The antenna system of claim 1 wherein the first antenna element and the second antenna element have lengths of approximately one eighth a wavelength or less.

9. The antenna system of claim 1 wherein selected portions of the ground plane are removed from under the first antenna element and the second antenna element.

10. The antenna system of claim 1 wherein the ground plane further comprises a third corner and a fourth corner, the third corner being in spaced relation to the fourth corner, the third corner and the fourth corner lying along a second common edge of the ground plane; and wherein a third antenna element is disposed at the third corner of the ground plane and includes a third slot, and a fourth antenna element is disposed at the fourth corner of the ground plane and includes a fourth slot.

11. The antenna system of claim 10 wherein the first antenna element and the second antenna element operate in a first frequency band and the third antenna element and the fourth antenna element operate in a second frequency band.

12. The antenna system of claim 1 wherein the first common edge is less than one third wavelength in length.

13. An antenna system comprising:

a ground plane having a first corner and a second corner, the first corner being in spaced relation to the second corner, the first corner and the second corner lying along a common edge of the ground plane; and a first antenna element disposed at the first corner of the ground plane and including a first slot and being fed by a first signal source, and a second antenna element disposed at the second corner of the ground plane and including a second slot and being fed by a second signal source, wherein the ground plane comprises a first reentrant perimeter that extends inward underneath at least a first portion of the first antenna element and wherein the ground plane comprises a second reentrant perimeter that extends inward underneath at least a second portion of the second antenna element, and wherein the at least first portion of the first antenna element and the at least second portion of the second antenna element do not overlie the ground plane, and wherein the first antenna element and the second antenna element are fed with an electromagnetic signal, the electromagnetic signal at the first antenna element being approximately 90 degrees shifted from the signal at the second antenna element, the first antenna element and the second antenna element forming an antenna structure, the antenna structure transmitting circularly polarized radiation.

14. The antenna system of claim 13 wherein ground plane comprises a shape that is a polygon.

15. The antenna system of claim 13 further comprising a dielectric positioned between the first antenna element and the ground plane, and the second antenna element and the ground plane.

16. The antenna system of claim 13 further comprising a first tuning circuit coupled to the first antenna element and a second tuning circuit coupled to the second antenna element, wherein the first tuning circuit and the second tuning circuit are adapted and configured to change a center operating frequency.

17. The antenna system of claim 16 wherein the first tuning circuit and the second tuning circuit comprise at least one capacitor.

18. The antenna system of claim 16 wherein the first tuning circuit is actuated by a first switch and the second tuning element is actuated by a second switch.

19. The antenna system of claim 13 wherein the first antenna element and the second antenna element are substantially v-shaped.

20. The antenna system of claim 13 wherein the first antenna element and the second antenna element have lengths of approximately one-eighth a wavelength or less.

* * * * *